US007448213B2

(12) United States Patent
Mitani

(10) Patent No.: US 7,448,213 B2
(45) Date of Patent: Nov. 11, 2008

(54) HEAT ENERGY RECOVERY APPARATUS

(75) Inventor: Shinichi Mitani, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 321 days.

(21) Appl. No.: 11/366,438

(22) Filed: Mar. 3, 2006

(65) Prior Publication Data

US 2006/0218924 A1 Oct. 5, 2006

(30) Foreign Application Priority Data

Apr. 1, 2005 (JP) ..... 2005-106310

(51) Int. Cl.
*F02G 3/00* (2006.01)

(52) U.S. Cl. ..... 60/616; 60/620; 60/682

(58) Field of Classification Search ..... 60/614, 60/616, 620, 682–683
See application file for complete search history.

(56) References Cited

U.S. PATENT DOCUMENTS

| | | | | |
|---|---|---|---|---|
| 3,708,979 | A * | 1/1973 | Bush et al. | 60/522 |
| 4,369,623 | A | 1/1983 | Johnson | |
| 5,205,120 | A | 4/1993 | Oblander et al. | |
| 6,216,462 | B1 | 4/2001 | Gray, Jr. | |
| 6,672,063 | B1 * | 1/2004 | Proeschel | 60/616 |
| 7,140,182 | B2 * | 11/2006 | Warren | 60/712 |
| 2001/0001362 | A1 | 5/2001 | Gray, Jr. | |
| 2003/0024237 | A1 | 2/2003 | Hiller et al. | |
| 2006/0207257 | A1 | 9/2006 | Turner et al. | |

FOREIGN PATENT DOCUMENTS

| | | |
|---|---|---|
| EP | 1 422 378 A1 | 5/2004 |
| FR | 2 303 955 | 10/1976 |
| GB | 127686 | 3/1918 |
| GB | 766703 | 1/1957 |
| GB | 2 251 027 A | 6/1992 |
| GB | 2 402 169 A | 12/2004 |
| JP | A 6-257462 | 9/1994 |
| JP | A 2002-266701 | 9/2002 |
| JP | A 2004-251224 | 9/2004 |
| WO | WO 01/06108 A1 | 1/2001 |

* cited by examiner

*Primary Examiner*—Hoang M Nguyen
(74) *Attorney, Agent, or Firm*—Oliff & Berridge, PLC

(57) ABSTRACT

A heat energy recovery apparatus include a compressor which has a piston for compressing sucked-in working gas; a heat exchanger which makes the working gas compressed by the compressor absorb heat of high temperature fluid; an expander which has a piston to be moved under pressure by expansion of the heat-absorbed working gas; and an accumulator which stores the working gas compressed by the compressor when required output is low or heat receiving capacity of the working gas is small. The apparatus preferably include a blocking unit which blocks discharge of the working gas from the expander when the heat receiving capacity of the working gas is small and the compressed working gas to the accumulator is being stored.

6 Claims, 8 Drawing Sheets

HEAT ENERGY RECOVERY APPARATUS

BACKGROUND OF THE INVENTION

1. Field of the Invention

The present invention relates to a heat energy recovery apparatus for converting thermal energy in which heat is absorbed by a heat exchanger to mechanical energy.

2. Description of the Related Art

Conventionally, there exists a heat cycle engine that converts thermal energy to mechanical energy.

For example, as this kind of a heat cycle engine, there is a Brayton cycle engine which includes a compressor which adiabatically compresses sucked-in working fluid (working gas), a heat exchanger which makes the working gas adiabatically compressed by the compressor absorb heat of high temperature fluid under isobaric pressure, and an expander which makes the working gas isobarically heat-received by the heat exchanger expand adiabatically; and which takes out output from a crankshaft using the expansion force, as disclosed in Japanese Patent Application (JP-A) Laid-Open No. 6-257462.

As described, the heat cycle engine is to obtain output using expansion force of heated working gas and, for example, is able to construct as an exhaust heat recovery apparatus (heat energy recovery apparatus) for an internal combustion engine by using exhaust heat of exhaust gas of the internal combustion engine.

Furthermore, as such a heat cycle engine, there is a Stirling cycle engine in which heating from outside to a cylinder sealed with working fluid (working gas) and cooling of working gas expanded by this heating are repeated; and depressing of a piston due to expansion force of the working gas increased in temperature and ascending of the piston due to cooling of the expanded working gas are repeated, thereby taking out output from a crankshaft, as disclosed in JP-A No. 2002-266701.

However, in the aforementioned heat cycle engine, if the engine works regardless that required engine output is low, output taken out with the work wastes, resulting in bringing degradation in recovery efficiency of thermal energy.

Furthermore, in the heat cycle engine such as the aforementioned Brayton cycle engine, each volume of the compressor and an expander is determined on the assumption that the working gas can sufficiently receive heat. For this reason, if the Brayton cycle engine works when heat receiving capacity of the working gas is small, such as in the case there is no heat or extremely low in heat in the heat exchanger, pumping loss is generated in the expander. Then, the compressor continues to generate compressed working gas in vain regardless of generating such a pumping loss, resulting in degradation in recovery efficiency of thermal energy.

SUMMARY OF THE INVENTION

Consequently, the present invention is to improve such conventional drawbacks and it is an object of the present invention to provide a heat energy recovery apparatus capable of suppressing degradation in recovery efficiency of thermal energy without performing waste work when required output is low or heat receiving capacity of working gas is small.

A heat energy recovery apparatus according to one aspect of the present invention includes a compressor which has a piston for compressing sucked-in working gas; a heat exchanger which makes the working gas compressed by the compressor absorb heat of high temperature fluid; an expander which has a piston to be moved under pressure by expansion of the heat-absorbed working gas; and an accumulator which stores the working gas compressed by the compressor when required output is low or heat receiving capacity of the working gas is small.

According to this heat energy recovery apparatus, in a state where required output is low or heat receiving capacity of working gas is small, compressed working gas generated by the compressor, which has not been effectively used in the past, can be stored in the accumulator and therefore waste work to be performed by the compressor is avoided.

The heat energy recovery apparatus may further include a blocking unit which blocks discharge of the working gas from the expander when the heat receiving capacity of the working gas is small and the compressed working gas to the accumulator is being stored.

According to this heat energy recovery apparatus, pumping loss of the expander can be reduced.

The heat energy recovery apparatus may further include a compressed working gas supply unit which supplies the compressed working gas stored in the accumulator to the heat exchanger. Thereby, compressed working gas in the accumulator is isobarically heat-received by the heat exchanger and then supplied to the expander to perform adiabatic expansion. For this reason, output can be taken out without making the compressor work.

In the heat energy recovery apparatus, the compressed working gas supply unit may block discharge of the working gas from the compressor when the compressed working gas stored in the accumulator is supplied to the heat exchanger.

Thereby, work of the compressor can be surely halted.

The heat energy recovery apparatus may further include a compressed working gas supply unit which supplies the compressed working gas stored in the accumulator to an intake path of an internal combustion engine.

Thereby, since the compressed working gas in the accumulator can be supplied to the combustion chamber of the internal combustion engine, the amount of intake air of the combustion chamber increases; whereby output of the internal combustion engine can be improved.

The heat energy recovery apparatus may further include a compressed working gas supply unit which supplies the compressed working gas stored in the accumulator to an exhaust path at an upper stream side than a catalytic converter in an internal combustion engine.

Thereby, in cold time such as immediately after start of the internal combustion engine, the compressed working gas of the accumulator can be supplied to the upper stream of the catalytic converter as secondary air. For this reason, floor temperature of the catalytic converter increases and early activation of the catalytic converter can be realized.

The heat energy recovery apparatus according to the present invention can suppress degradation in recovery efficiency of thermal energy because waste work may not be performed in a state where required output is low or heat receiving capacity of working gas is small, as described above. Furthermore, degradation in recovery efficiency of thermal energy can be further suppressed by reducing pumping loss of the expander.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of heat energy recovery apparatus according to the present invention will be described below with reference to drawings in detail. In addition, the present invention is not limited by these embodiments.

A heat energy recovery apparatus according to a first embodiment of the present invention will be described with reference to FIG. 1 to FIG. 7.

Figure 1:
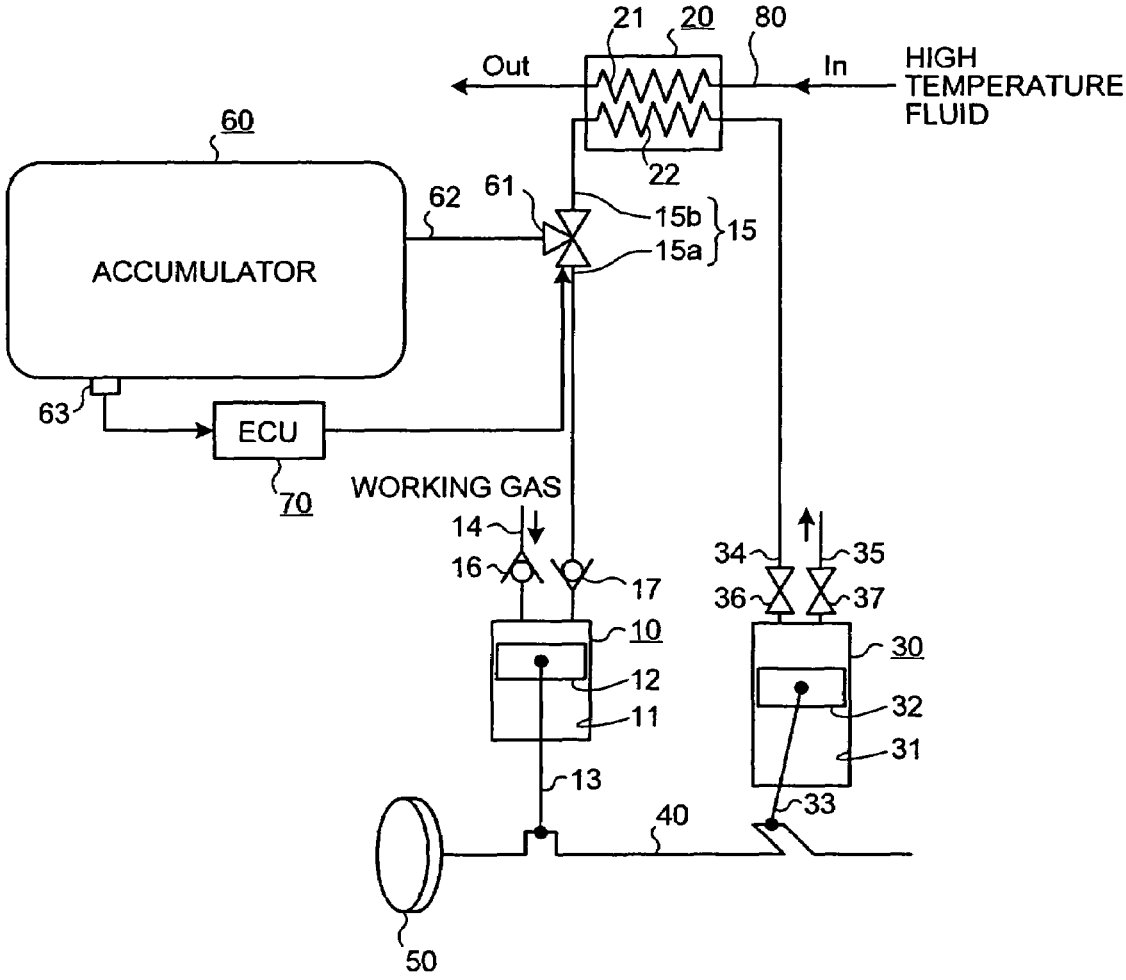
FIG. 1 is a view showing a configuration of a heat energy recovery apparatus according to a first embodiment of the present invention.

The heat energy recovery apparatus of the first embodiment is a Brayton cycle engine in which working fluid is processed using heat of high temperature fluid as follows: adiabatic compression→isobaric heat receiving →adiabatic expansion→isobaric heat radiation, thereby obtaining driving force. As shown in FIG. 1, the heat energy recovery apparatus includes a compressor 10 which adiabatically compresses suck-in working fluid, a heat exchanger 20 which makes the working fluid adiabatically compressed by the compressor 10 absorb heat of high temperature fluid under isobaric pressure, and an expander 30 which makes the working fluid isobarically heat-received by the heat exchanger 20 expand adiabatically.

Here, exhaust gas discharged from an internal combustion engine (not shown in the figure) is used as the high temperature fluid and exhaust heat of the exhaust gas is recovered to convert to mechanical energy. That is, the heat energy recovery apparatus exemplified here is an exhaust heat recovery apparatus that recovers exhaust heat of the internal combustion engine. Furthermore, the first embodiment explains with an example of gas such as air (referred to as "working gas" below) as the working fluid to be sucked into the compressor 10.

First, the heat exchanger 20 of the first embodiment will be described.

The heat exchanger 20 includes a first flow path 21 in which the high temperature fluid flows and a second flow path 22 in which working gas adiabatically compressed by the compressor 10 flows. Here, it is preferable that the first and the second flow paths 21 and 22 are disposed so that a flowing direction of the high temperature fluid and a flowing direction of the working gas are opposed to each other in order to enhance endothermic efficiency (heat exchanger efficiency) to the working gas.

Here, exhaust gas from the internal combustion engine is used as the high temperature fluid and therefore the heat exchanger 20 of the first embodiment is disposed on an exhaust path 80 of the internal combustion engine shown in FIG. 1 so that the exhaust gas flows into the first flow path 21. Here, it is preferable that the heat exchanger 20 is disposed at a position (on the upper stream side of the exhaust path 80) as close to a combustion chamber of the internal combustion engine as possible in order to effectively use the exhaust heat of the exhaust gas. Consequently, the heat exchanger 20 of the first embodiment is disposed at an assembly portion of an exhaust manifold, for example.

Subsequently, the compressor 10 of the first embodiment will be described.

The compressor 10 includes a cylinder 11 whose volume $V_{comp}$ is constant and a piston 12 that reciprocates in the cylinder 11. The piston 12 is coupled with a crankshaft 40 via a connecting rod 13. In addition, the crankshaft 40 is provided with a wheel 50.

Furthermore, the compressor 10 includes an intake air flow path 14 which leads working gas with atmospheric pressure into the cylinder 11 and an exhaust flow path 15 which leads working gas adiabatically compressed by the piston 12 in the cylinder 11 into the second flow path 22 of the heat exchanger 20; and the intake air flow path 14 and the exhaust flow path 15 are provided with an intake air side open/close valve 16 and an exhaust air side open/close valve 17, respectively.

Here, a check valve (intake air side reed valve) which makes the working gas flow into the cylinder 11 by inside pressure difference between the intake air flow path 14 and the cylinder 11 and, at the same time, prevents the working gas from back-flowing into the intake air flow path 14, is used as the intake air side open/close valve 16. Furthermore, a check valve (exhaust air side reed valve) which makes the working gas after adiabatically compressed flow into the second flow path 22 of the heat exchanger 20 by inside pressure difference between the exhaust flow path 15 and the cylinder 11 and, at the same time, prevents the working gas from back-flowing into the cylinder 11, is used as the exhaust air side open/close valve 17.

Subsequently, the aforementioned expander 30 will be described.

The expander 30 includes a cylinder 31 whose volume $V_{exp}$ (here, $V_{exp} \geqq V_{comp}$) is constant and a piston 32 which reciprocates in the cylinder 31. The piston 32 is coupled with the crankshaft 40 which is the same as in the case of the compressor 10 via a connecting rod 33.

Furthermore, the expander 30 includes an intake air flow path 34 which leads working gas isobarically heat-received by the heat exchanger 20 into the cylinder 31 and an exhaust flow path 35 which leads working gas after adiabatically compressed into outside the cylinder 31. The intake air flow path 34 and the exhaust flow path 35 are provided with an intake air side open/close valve 36 and an exhaust air side open/close valve 37, respectively.

Here, as the intake air side open/close valve 36 and exhaust air side open/close valve 37, for example, a rotational synchronizing valve which performs open/close operation in synchronization with the rotation of the crankshaft 40 by means of a chain, sprocket, and the like is used.

Figure 2A:
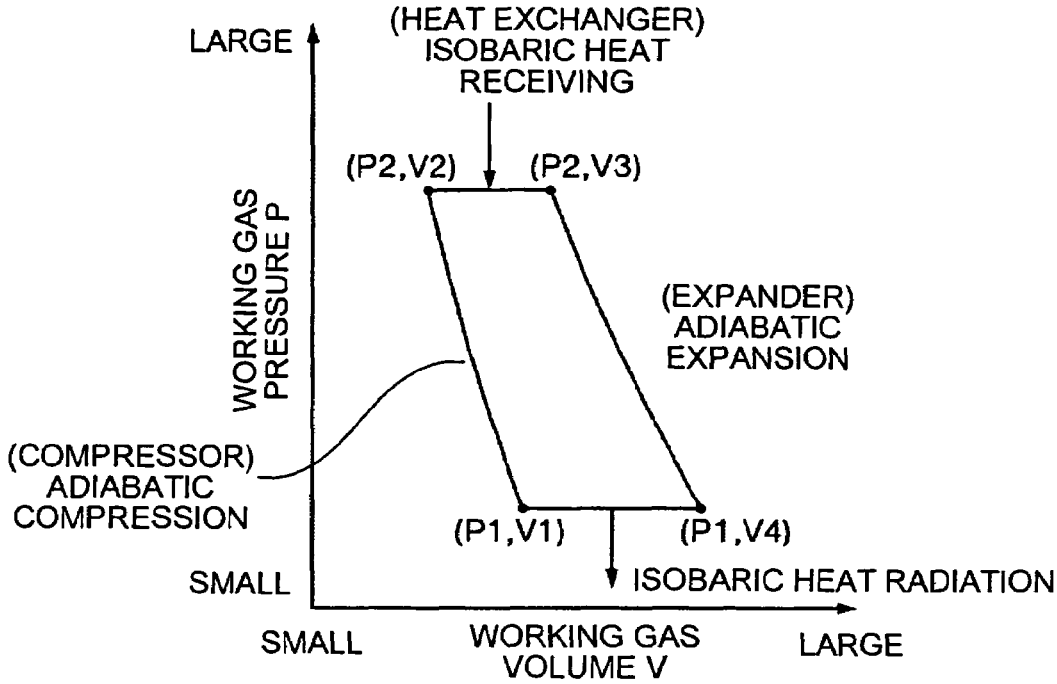
FIG. 2A is a P-V diagram for explaining a Brayton cycle engine.
Figure 2B:
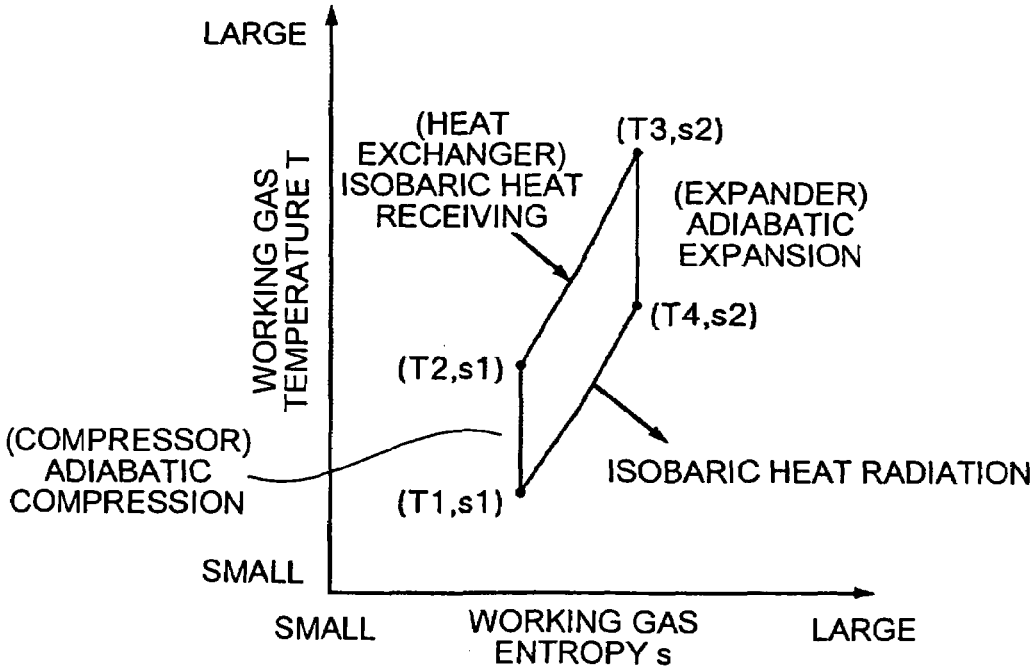
FIG. 2B is a T-s diagram for explaining the Brayton cycle engine.

In this exhaust heat recovery apparatus, as shown in P-V diagram of FIGS. 2A and T-s diagram of FIG. 2B, working gas with a pressure P1 (=atmospheric pressure) is sucked in the cylinder 11 of the compressor 10 from the intake air flow path 14 and the piston 12 adiabatically compresses working gas with a pressure P1, volume V1 (=$V_{comp}$), temperature T1, entropy s1 the compressor 10. After that, the adiabatically compressed working gas with a pressure P2, volume V2, temperature T2, and entropy s1 is discharged from the exhaust flow path 15 and is isobarically heat-received with exhaust heat of the exhaust gas by the heat exchanger 20.

Then, isobarically heat-received working gas with a pressure P2, volume V3, temperature T3, entropy s2 flows into the cylinder 31 of the expander 30 via the intake air flow path 34 and lowers the piston 32 while adiabatically compressing. Working gas after adiabatic expansion with a pressure P1, volume V4, temperature T4, entropy s2 is discharged (isobaric heat radiation) from the expander 30 via the exhaust flow path 35.

In this exhaust heat recovery apparatus, exhaust heat of the exhaust gas is recovered in such a way and the crankshaft 40 is rotated in the adiabatic expansion stroke of the expander 30.

However, in this exhaust heat recovery apparatus, if the apparatus works when the required output (required value of output taken out from the crankshaft 40) is low, output taken out by the work wastes, resulting in bringing degradation in recovery efficiency of thermal energy.

Figure 3:
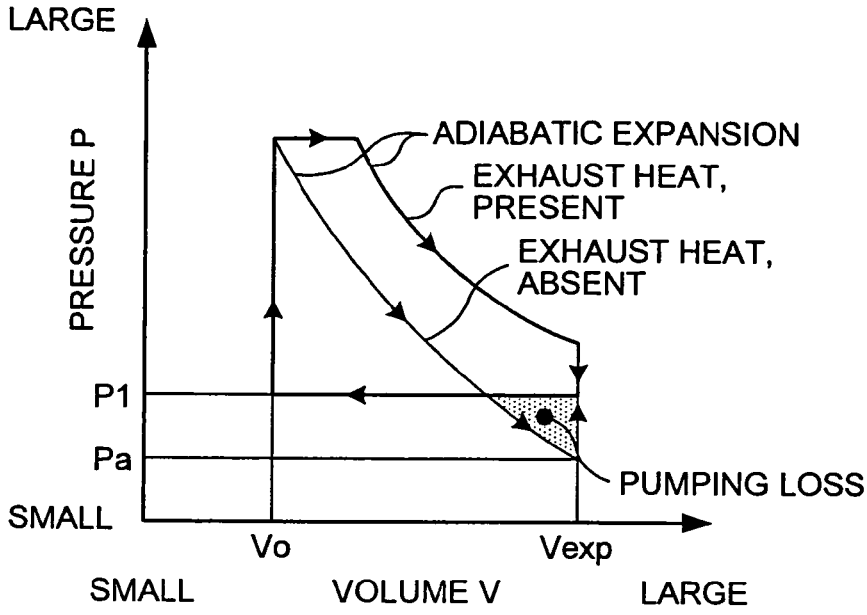
FIG. 3 is a view showing a difference on a P-V diagram of an expander according to the presence or absence of exhaust heat.

Furthermore, volume $V_{comp}$ of the compressor 10 and volume $V_{exp}$ of the expander 30 in the aforementioned first embodiment are set on the assumption that the working gas can sufficiently receive exhaust heat by the heat exchanger 20. For this reason, for example, when the internal combustion engine is temporarily halted and in the state where heat receiving capacity of the working gas is small, such as in the state there is no exhaust heat or extremely low as in the state during deceleration of the internal combustion engine; the respective volume $V_{comp}$ and $V_{exp}$ are unbalanced and consequently drag resistance with pumping loss of the expander 30 shown in FIG. 3 is generated. In addition, FIG. 3 is a P-V diagram of the aforementioned expander 30, showing a difference according to the presence or absence of exhaust heat. Furthermore, the compressor 10 continues to generate compressed working gas and works regardless of generating such a pumping loss, resulting in degradation in recovery efficiency of thermal energy.

Consequently, in the first embodiment, there is provided an accumulator 60 shown in FIG. 1, in which compressed working gas generated by the compressor 10 can be stored when required output is low or heat receiving capacity of working gas is small. The accumulator 60 is connected to the exhaust flow path 15 via a branch flow path 62 and a three-way valve 61 provided on the exhaust flow path 15 of the compressor 10 (specifically, between a first exhaust flow path 15*a* and a second exhaust flow path 15*b*).

The three-way valve 61 of the first embodiment performs switching operation by an electronic control unit (ECU) 70 served as control means of the internal combustion engine.

Specifically, for example, the three-way valve 61 generally communicates between the first exhaust flow path 15*a* and the second exhaust flow path 15*b* and, at the same time, blocks between these paths and the branch flow path 62. Under such a condition, when the electronic control unit 70 detects a state where the required output is low or a state where the heat receiving capacity is small, the electronic control unit 70 controls the three-way valve 61 to communicate between the first exhaust flow path 15*a* and the branch flow path 62 and, at the same time, to block between these paths and the second exhaust flow path 15*b*. Thereby, compressed working gas generated by the compressor 10 can be stored in the accumulator 60 via the first exhaust flow path 15*a* and the branch flow path 62.

Here, the electronic control unit 70, for example, judges a temporary halt state and a deceleration state of the internal combustion engine based on the engine rotation speed of the internal combustion engine, so that a state where the heat receiving capacity of the working gas is small, such as "there is no exhaust heat" and "there is extremely a little exhaust heat," can be detected. Furthermore, the electronic control unit 70 can detect a state that heat receiving capacity of the working gas is small based on a detection signal of an exhaust temperature sensor (not shown in the figure) disposed on the exhaust path 80 of the internal combustion engine.

In this way, according to the first embodiment, in a state where the required output is low or the heat receiving capacity of the working gas is small, the working gas flowing-into the expander 30 is blocked and the compressed working gas generated by the compressor 10 can be stored by the accumulator 60. That is, the exhaust heat recovery apparatus can suppress degradation in recovery efficiency of thermal energy because work of the compressor 10 that has been wasted in the past when the required output is low is accumulated in the accumulator 60.

However, the compressed working gas accumulated in the accumulator 60 can be used in various kinds of modes. However, the compressed working gas reduces with continued supply and cannot be effectively used. Here, when the compressed working gas from the accumulator 60 reduces, internal pressure thereof lowers. For this reason, in the first embodiment, a pressure sensor 63 shown in FIG. 1, which detects internal pressure of the accumulator 60, is provided to make the electronic control unit 70 detect reduction of the compressed working gas based on a detection signal thereof.

A use mode of compressed working gas accumulated in the accumulator 60 will be explained below with an example.

First, the case where the compressed working gas is used by a Brayton cycle will be described.

Here, compressed working gas stored in the accumulator 60 is supplied to the second flow path 22 of the heat exchanger 20 to perform isobaric heat receiving to the compressed working gas. For this reason, a compressed working gas supply path, which leads the compressed working gas of the accumulator 60 to the second flow path 22 of the heat exchanger 20 served as a supply object, is provided.

The compressed working gas supply path may be disposed between the accumulator 60 and the a second flow path 22 as exclusive use; however, here, already provided branch flow path 62 and second exhaust flow path 15*b* are used as the compressed working gas supply path.

Figure 4:
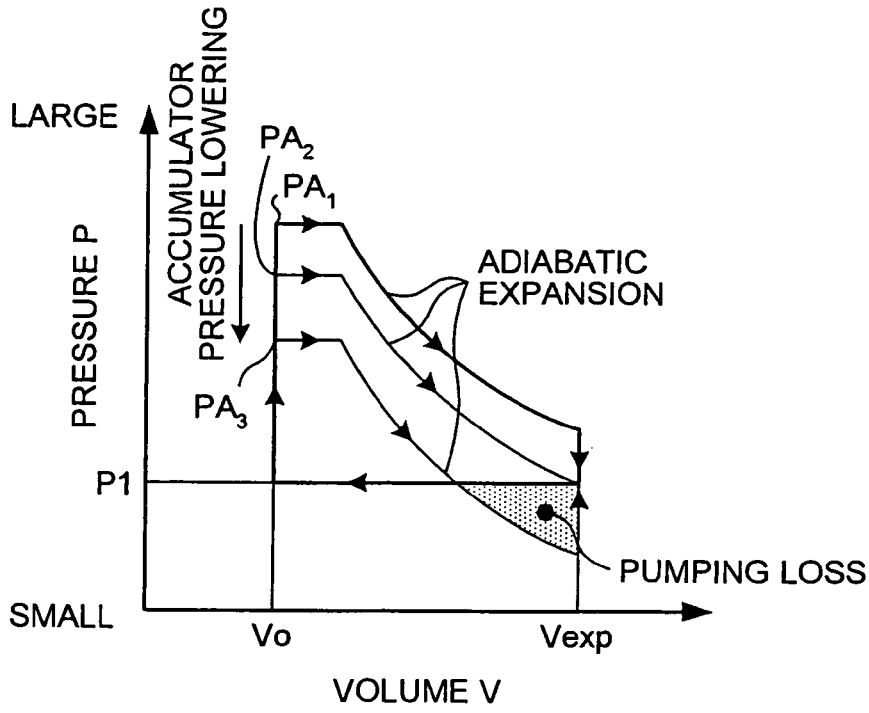
FIG. 4 is a view showing a P-V diagram of an expander when compressed working gas of an accumulator is used with a Brayton cycle for showing a difference according to internal pressure of the accumulator.
Figure 5:
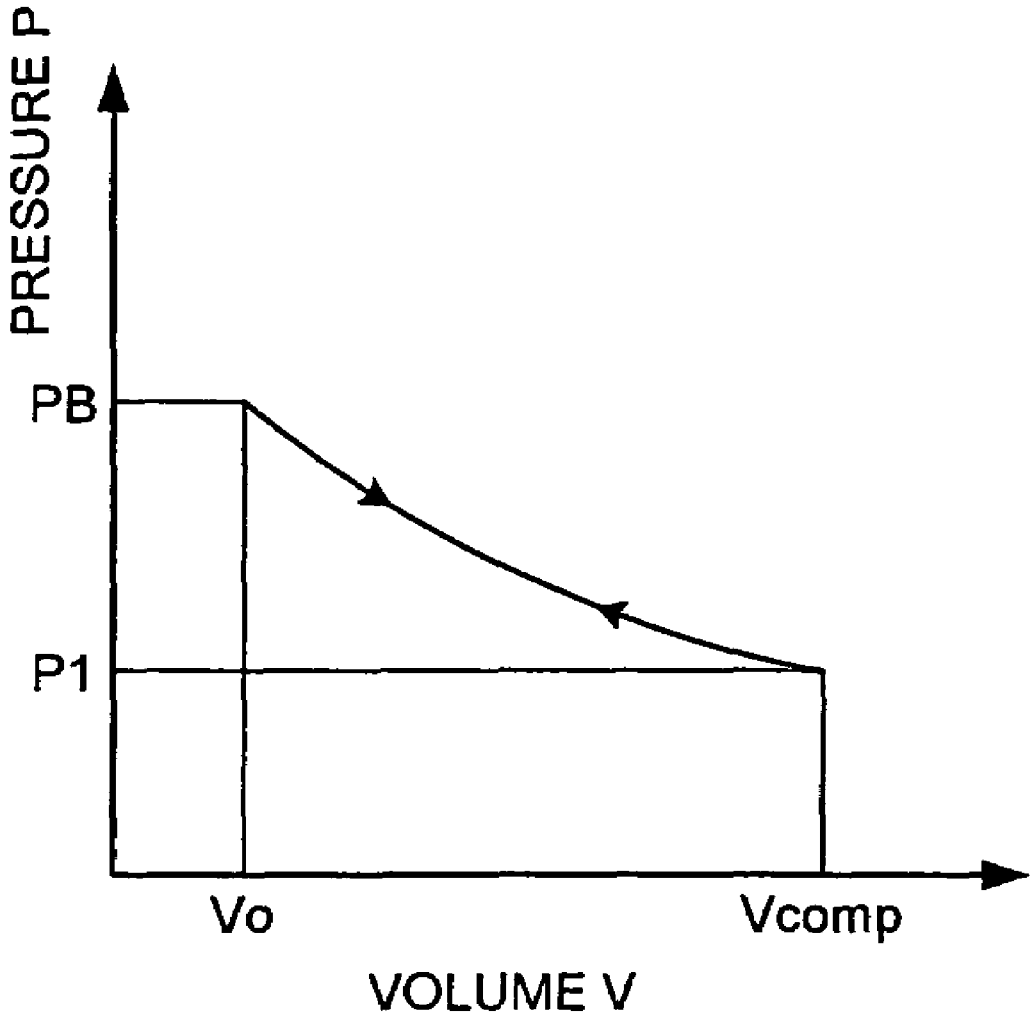
FIG. 5 is a view showing a P-V diagram of a compressor when the compressed working gas of the accumulator is used with the Brayton cycle.

In such a case, for example, when a state that exhaust heat is sufficiently supplied to the heat exchanger 20 is detected and an internal pressure of the accumulator 60 is not less than "$PA_2$" shown in FIG. 4, the electronic control unit 70 controls the three-way valve 61 to communicate between the second exhaust flow path 15*b* and the branch flow path 62 and, at the same time, to block between these paths and the first exhaust flow path 15*a*.

Here, the aforementioned internal pressure $PA_2$ denotes an internal pressure value of the accumulator 60 which generates pumping loss in the expander 30 if the compressed working gas of the accumulator 60 is used when the internal pressure is lower than $PA_2$ (for example, internal pressure $PA_3$ shown in FIG. 4); it is a threshold that can avoid generating such pumping loss.

Thereby, compressed working gas with a pressure $PA_1$ shown in FIG. 4 in the accumulator 60 is supplied to the heat exchanger 20 and is isobarically heat-received. Then, in the expander 30, working gas with a pressure $PA_1$ is supplied from the heat exchanger 20 and is adiabatically expanded to rotate the crankshaft 40.

On the other hand, in the compressor 10, as described above, the second exhaust flow path 15*b* and the branch flow path 62 are blocked to the first exhaust flow path 15*a* and therefore discharge of the working gas to the first exhaust flow path 15*a* is blocked. For this reason, in the compressor 10 in such a case, as shown in a P-V diagram of FIG. 5, a state with an atmospheric pressure P1 and volume $V_{comp}$ and a state with a pressure PB and volume Vo are repeated, and therefore loss is not generated. In addition, "PB" in FIG. 5 denotes a pressure of the compressor 10 when the piston 12 is located at the top dead center and "Vo" denotes a volume of the compressor 10 when the piston 12 is located at the top dead center.

In this way, when the compressed working gas accumulated by the accumulator 60 is used with a Brayton cycle, work at the compressor 10 can be eliminated, thereby enabling to efficiently increase recovery work of exhaust heat. More particularly, here, working gas cannot be discharged from the compressor 10 to the first exhaust flow path 15*a* and therefore work of the compressor 10 is surely halted, whereby efficient recovery work of exhaust heat can be more effectively performed.

Here, the electronic control unit 70 monitors internal pressure of the accumulator 60 while referring the detection signal of the pressure sensor 63; when the internal pressure lowers to the aforementioned threshold $PA_2$, the three-way valve 61 is controlled to communicate between the first exhaust flow path 15*a* and the second exhaust flow path 15*b* and, at the same time, to block between these paths and the branch flow path 62. Thereby, the compressor 10 starts to work (generates compressed working gas) and returns to a normal Brayton cycle.

As described above, here, compressed working gas supply means is composed by the branch flow path 62, second exhaust flow path 15*b*, three-way valve 61, pressure sensor 63, and electronic control unit 70; and, compressed working gas of the accumulator 60 is supplied to the second flow path 22 of the heat exchanger 20 by the compressed working gas supply means. Furthermore, the compressed working gas supply means, as described above, controls the three-way valve 61 to block discharge of the working gas from the compressor 10 when compressed working gas of the accumulator 60 is supplied to the second flow path 22 of the heat exchanger 20.

Next, the case where compressed working gas accumulated by the accumulator 60 is used as output assist of an internal combustion engine 81 shown in FIG. 6 will be described. That is, when the internal combustion engine 81 cannot satisfy the required output by a normal amount of intake air, compressed working gas (compressed air) of the accumulator 60 is supplied to the combustion chamber by only necessary amount to achieve the required output.

Figure 6:
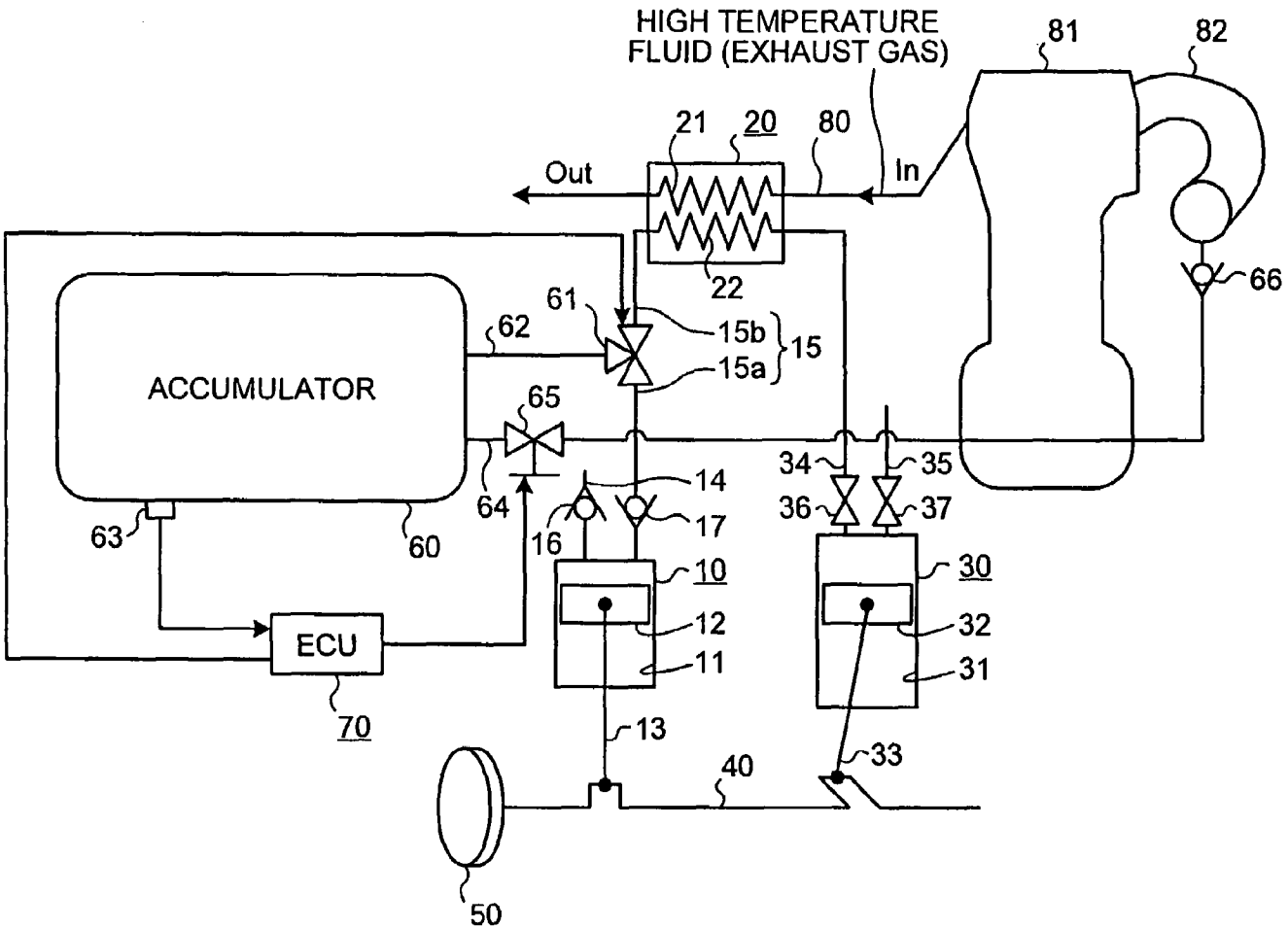
FIG. 6 is a view showing a configuration when the compressed working gas of the accumulator is used as output assist of an internal combustion engine.

Here, as shown in FIG. 6, a compressed working gas supply path 64, which leads the compressed working gas (compressed air) of the accumulator 60 to an in take air path 82 of the internal combustion engine 81 served as a supply object, is provided; and a flow control valve 65 of the compressed working gas is provided on the compressed working gas supply path 64. Furthermore, the compressed working gas supply path 64 has one end communicated to the inside of the accumulator 60 and another end communicated to the intake path 82 of the internal combustion engine 81 via a check valve 66. The check valve 66 makes the compressed working gas flow into the intake path 82 by pressure difference between the compressed working gas supply path 64 and the intake path 82 and, at the same time, prevents the working gas from back-flowing into the compressed working gas supply path 64.

In such a case, when the internal combustion engine 81 can not satisfy the required output and the internal pressure of the accumulator 60 is not less than a predetermined value, the electronic control unit 70 controls the flow control valve 65 to supply the compressed working gas having a volume required by the internal combustion engine 81 to the intake path 82. Thereby, since an amount of intake air to the combustion chamber increases, output of the internal combustion engine 81 enhances, whereby the required output can be satisfied.

Here, the predetermined value denotes a pressure value required for activating the check valve 66 and a value higher than a pressure (for example, atmospheric pressure) of the intake path 82.

Furthermore, as for an amount of control of the flow control valve 65, for example, mapping data and a database consisted of a relationship between an amount of compressed working gas necessary for output assist of the internal combustion engine 81 and an angle of open valve of the flow control valve 65 are preliminarily provided. Then, the electronic control unit 70 controls the flow control valve 65 by loading the angle of open valve of the flow control valve 65 corresponding to the required amount of the compressed working gas from the mapping data or the like.

In addition, in such case, the first exhaust flow path 15*a* and the second exhaust flow path 15*b* are communicated and, at the same time, the three-way valve 61 is controlled so as to block between the these paths and the branch flow path 62; a normal Brayton cycle is performed.

The electronic control unit 70 monitors the internal pressure of the accumulator 60 while referring the detection signal of the pressure sensor 63 even in such case and controls the flow control valve 65 to be closed when the internal pressure lowers to the aforementioned predetermined value.

As described above, here, the compressed working gas supply path 64, flow control valve 65, check valve 66, pressure sensor 63, and electronic control unit 70 constitute compressed working gas supply means for supplying the compressed working gas of the accumulator 60 to the intake path 82 of the internal combustion engine 81.

Next, the case where compressed working gas accumulated by an accumulator 60 is used as secondary air to an exhaust flow path at the start time of an internal combustion engine 81 shown in FIG. 7 will be described.

Figure 7:
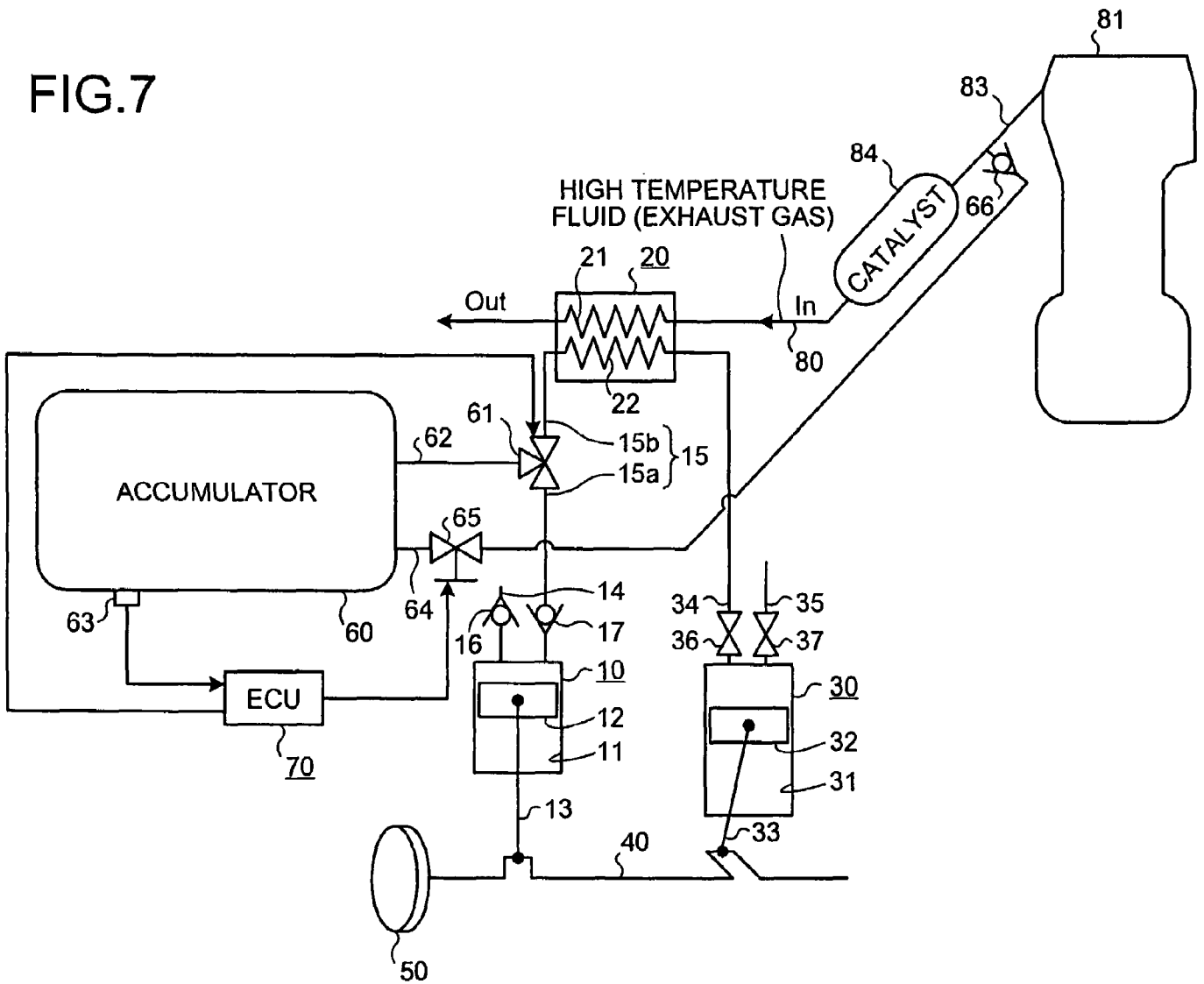
FIG. 7 is a view showing a configuration when the compressed working gas of the accumulator is used as secondary air to an exhaust flow path at start time of the internal combustion engine.

Generally, in the internal combustion engine 81, a catalytic converter 84 shown in FIG. 7, made up of a three-way catalyst or the like, which makes toxic substance such as hydrocarbon (referred to as "HC"), carbon monoxide (referred to as "CO"), nitrogen oxides (referred to as "NOx") contained in exhaust gas oxidize and reduce, is provided on the exhaust flow path. The catalytic converter 84 can obtain a sufficient conversion efficiency of toxic substance, around a theoretical air fuel ratio and activates by becoming not less than a predetermined temperature (activation temperature).

Here, in cold time such as immediately after start of the internal combustion engine 81, compared to the case after warm air, intake air temperature is generally low and fuel vaporization characteristic degrades; and therefore an air fuel ratio is thicker than a theoretical air fuel ratio by increasing an amount of fuel consumption. For this reason, during such cold time, the conversion efficiency of HC and CO at the catalytic converter 84 lowers, and therefore there arises a drawback in that concentration of HC and CO contained in the exhaust gas after passing the catalytic converter 84 become high.

Consequently, here, in order to reduce HC and CO during cold time, the compressed working gas (compressed air) of the accumulator 60 is supplied as secondary air to an exhaust path 83 at the upper stream side with respect to the exhaust gas flow of the catalytic converter 84.

Also in such case, as shown in FIG. 7, a compressed working gas supply path 64 which leads the compressed working gas (compressed air) of the accumulator 60 to the exhaust path 83 served as a supply object via a check valve 66 and a flow control valve 65 of the compressed working gas is provided on the compressed working gas supply path 64.

For example, when immediately after the internal combustion engine 81 starts and internal pressure of the accumulator 60 is not less than a predetermined value, an electronic control unit 70 in such case controls the flow control valve 65 to supply compressed working gas with a volume capable of performing early activation of the catalytic converter 84 to the exhaust path 83. Thereby, temperature of the catalytic converter 84 is increased to activate, whereby HC and CO at immediately after the start of the engine can be reduced.

Here, the predetermined value denotes a pressure value required for operating the check valve 66 and a value higher than a pressure of the exhaust path 83.

Furthermore, as for an amount of control of the flow control valve 65, for example, mapping data or a database, made up of a relationship among a floor temperature of the catalytic converter 84, an amount of compressed working gas capable of increasing the catalytic converter 84 to an activation temperature, and an angle of open valve of the flow control valve 65, is preliminarily provide. Then, the electronic control unit 70 controls the flow control valve 65 by loading the angle of open valve of the flow control valve 65 corresponding to the required amount of the compressed working gas from the mapping data or the like.

In addition, also here, in such case, the first exhaust flow path 15*a* and the second exhaust flow path 15*b* are communicated and, at the same time, the three-way valve 61 is controlled so as to block between the these paths and the branch flow path 62; a normal Brayton cycle is performed.

As described above, here, the compressed working gas supply path 64, flow control valve 65, check valve 66, pressure sensor 63, and electronic control unit 70 constitute compressed working gas supply means for supplying the compressed working gas of the accumulator 60 to the exhaust path 83 which is placed at an upper stream side than the catalytic converter 84 in the internal combustion engine 81.

Figure 8:
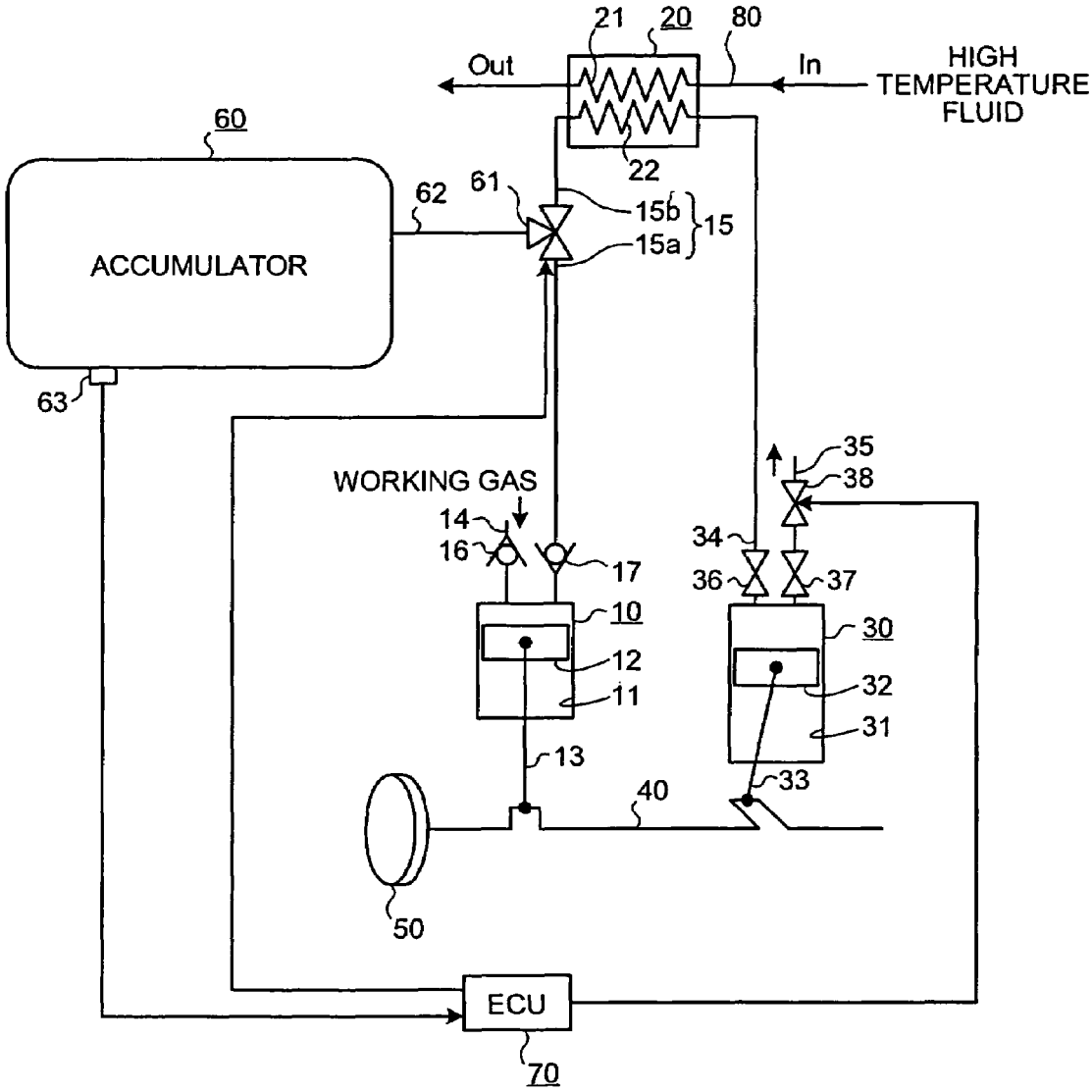
FIG. 8 is a view showing a configuration of a heat energy recovery apparatus according to a second embodiment of the present invention.

A heat energy recovery apparatus according to a second embodiment of the present invention will be described with reference to FIG. 8 to FIG. 9B. In addition, also here, an exhaust heat recovery apparatus which recovers exhaust heat of an internal combustion engine (not shown in the figure) is exemplified as the heat energy recovery apparatus.

The exhaust heat recovery apparatus according to the second embodiment, in the exhaust heat recovery apparatus of the aforementioned first embodiment, is one in which pumping loss of the expander 30, which generates in storing the compressed working gas to the accumulator 60, is reduced.

Figure 9A:
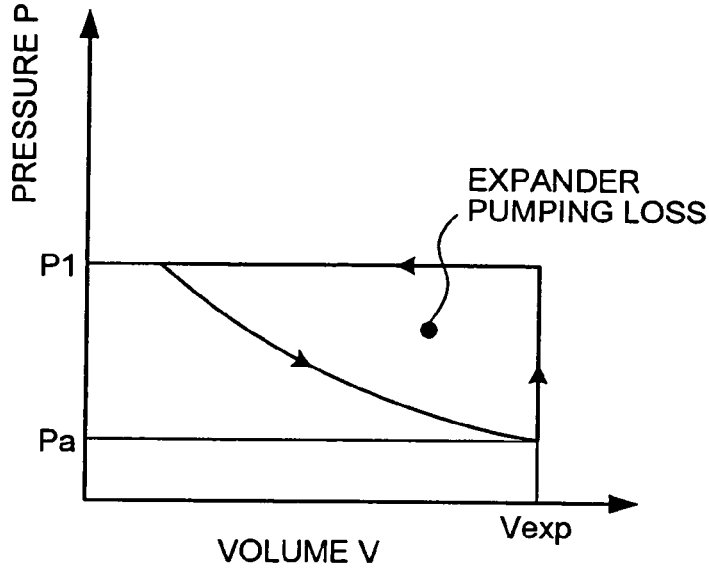
FIG. 9A is an enlarged view showing pumping loss of the expander shown in FIG. 3.

Here, an enlarged view of the pumping loss of the expander 30 in FIG. 3 is shown in FIG. 9A. The reference character "P1" shown in FIG. 3 and FIG. 9A denotes atmospheric pressure and "Pa" denotes negative pressure. Furthermore, the reference character "Vo" denotes a volume of the expander 30 when the piston 32 is located at the top dead center; and "$V_{exp}$" denotes a volume of the expander 30 when the piston 32 is located at the bottom dead center.

As is apparent from FIG. 3 and FIG. 9A, in a state where heat receiving capacity of the working gas, such as "in a state where there is no exhaust heat," "in a state where there is extremely a little exhaust heat," or the like, is small; when the piston 32 is located at the bottom dead center, the expander 30 becomes negative pressure Pa; and when the exhaust air side open/close valve 37 opens in synchronization with the rotation of the crankshaft 40, the expander 30 instantaneously becomes atmospheric pressure P1 with the volume $V_{exp}$ maintained constant. After that, the piston 32 moves to the top dead center with the expander 30 maintained at atmospheric pressure P1.

In this way, the pumping loss in the expander 30 increases because it instantaneously becomes atmospheric pressure P1 when the exhaust air side open/close valve 37 opens.

Consequently, in the second embodiment, in order to reduce the pumping loss, in the exhaust heat recovery apparatus of the aforementioned first embodiment, blocking means capable of blocking discharge of the working gas from the expander 30 when heat receiving capacity of the working gas is small and the compressed working gas to the accumulator 60 is being stored. Specifically, as shown in FIG. 8, an open/close valve 38 capable of opening/closing by the electronic control unit 70 is provided on the lower stream side of the exhaust air side open/close valve 37 in the exhaust flow path 35 of the expander 30. The open/close valve 38 is a normally open state and is closed when heat receiving capacity of the working gas is small and the compressed working gas is stored in the accumulator 60.

Figure 9B:
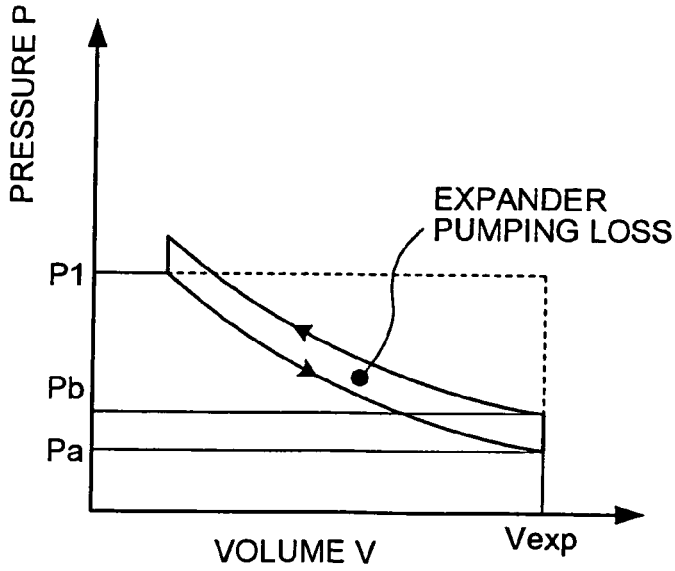
FIG. 9B is a view showing pumping loss of the expander in a state where an open/close valve of the second embodiment is closed.

Here, even when closing valve control for such open/close valve 38 is performed, the expander 30 becomes negative pressure Pa when the piston 32 is located at the bottom dead center as shown in FIG. 9B. However, here, after that, the open/close valve 38 of the lower stream side of the exhaust air side open/close valve 37 is closed when the exhaust air side open/close valve 37 is opened in synchronization with the rotation of the crankshaft 40; and therefore, working gas remained up to the open/close valve 38 in the exhaust flow path 35 is flown into the cylinder 31 due to negative pressure. Thereby, the pressure of the expander 30 is slightly increased in pressure from negative pressure Pa to negative pressure Pb, and then increased in pressure to atmospheric pressure P1 side with the piston 32 ascended.

In this way, in the second embodiment, the open/close valve 38 is closed when heat receiving capacity of the working gas is small and in the state where the compressed working gas is stored in the accumulator 60, whereby pumping loss in the expander 30 is considerably reduced.

That is, when the electronic control unit 70 detects that heat receiving capacity of the working gas is small, the electronic control unit 70 of the second embodiment communicates between the first exhaust flow path 15*a* and the branch flow path 62, controls the three-way valve 61 so as to block between these paths and second exhaust flow path 15*b*, and further controls the open/close valve 38 to close. Thereby, the compressed working gas generated by the compressor 10 is accumulated in the accumulator 60 and pumping loss in the expander 30 is considerably reduced. For this reason, in the exhaust heat recovery apparatus of the second embodiment, degradation in recovery efficiency of thermal energy can be further suppressed.

Here, also in the second embodiment, the compressed working gas accumulated in the accumulator 60 can be used in various modes as exemplified in the first embodiment.

As described above, the heat energy recovery apparatus according to the present invention is useful for suppressing waste work when required output is low or heat receiving capacity of working gas is small and, more particularly, suitable for technology for suppressing degradation in recovery efficiency of thermal energy.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heat energy recovery apparatus, comprising:

a compressor which has a piston for compressing sucked-in working gas;

a heat exchanger which makes the working gas compressed by the compressor absorb heat of high temperature fluid;

an expander which has a piston to be moved under pressure by expansion of the heat-absorbed working gas;

an accumulator which stores the working gas compressed by the compressor; and a compressed working gas supply unit which switches a supply of the compressed working gas from the compressor either to the heat exchanger or to the accumulator, wherein the compressed working gas supply unit switches the supply of the compressed working gas from the compressor to the accumulator when a required output of an engine power, a temperature of the fluid, or a pressure of the fluid, is low.

2. The heat energy recovery apparatus according to claim 1, further comprising a blocking unit which blocks discharge of the working gas from the expander when the heat receiving capacity of the working gas is small and the compressed working gas to the accumulator is being stored.

3. The heat energy recovery apparatus according to claim 1, wherein the compressed working gas supply unit supplies the compressed working gas stored in the accumulator to the heat exchanger.

4. The heat energy recovery apparatus according to claim 3, wherein the compressed working gas supply unit blocks discharge of the working gas from the compressor when the compressed working gas stored in the accumulator is supplied to the heat exchanger.

5. The heat energy recovery apparatus according to claim 1, wherein the compressed working gas supply unit which supplies the compressed working gas stored in the accumulator to an intake path of an internal combustion engine.

6. The heat energy recovery apparatus according to claim 1, wherein the compressed working gas supply unit which supplies the compressed working gas stored in the accumulator to an exhaust path at an upper stream side than a catalytic converter in an internal combustion engine.

* * * * *